US012433360B1

(12) United States Patent
Oehler

(10) Patent No.: US 12,433,360 B1
(45) Date of Patent: Oct. 7, 2025

(54) DUAL-LAYER ELASTIC BELT WITH ENHANCED DURABILITY AND CUSTOMIZATION

(71) Applicant: Armin Eugen Oehler, Greenville, SC (US)

(72) Inventor: Armin Eugen Oehler, Greenville, SC (US)

( * ) Notice: Subject to any disclaimer, the term of this patent is extended or adjusted under 35 U.S.C. 154(b) by 0 days.

(21) Appl. No.: 19/011,679

(22) Filed: Jan. 7, 2025

(51) Int. Cl.
*A41F 9/00* (2006.01)
*A44B 11/24* (2006.01)
*A44B 11/00* (2006.01)

(52) U.S. Cl.
CPC ..... *A41F 9/002* (2013.01); *A44B 11/24* (2013.01)

(58) Field of Classification Search
CPC ..... A41F 9/002; A44B 11/24
See application file for complete search history.

(56) References Cited

U.S. PATENT DOCUMENTS 3,828,521 A * 8/1974 Dulaney ..... B68C 1/14 54/23
3,873,406 A * 3/1975 Okazaki ..... D06N 3/0063 428/142
4,134,154 A * 1/1979 Faulkner ..... A41F 9/002 428/102
4,179,755 A * 12/1979 Clark ..... A41F 9/002 2/322
4,434,604 A * 3/1984 Bird ..... B68C 1/14 54/23
5,426,924 A * 6/1995 Harty ..... B68C 1/14 54/23
5,946,892 A * 9/1999 Siddoway ..... B68C 1/14 54/23
2002/0187696 A1* 12/2002 Veiga ..... B32B 27/04 442/76
2005/0039244 A1* 2/2005 Goldfarb ..... A41F 9/002 2/338
2017/0368388 A1* 12/2017 Colorado ..... A62B 35/04
2019/0133215 A1* 5/2019 Whalen ..... A63B 21/4017

* cited by examiner

*Primary Examiner* — Robert H Muromoto, Jr.

(57) ABSTRACT

An elastic belt includes a dual-layer structure, including a first elongate layer formed of an elastic material and a second elongate layer also formed of an elastic material, the second layer being coupled to the first layer along at least a portion of their respective lengths. The first layer provides a base with structural support, while the second layer features a thinner construction and is configured for aesthetic customization. A coupling means secures the two layers, maintaining their positional relationship during elongation to prevent overstretching or deformation. The belt further includes a fastening mechanism disposed at one end of the first layer, enabling secure and adjustable closure. The dual-layer construction allows for enhanced durability, elasticity, and design retention, with the first and second layers working together to provide improved functional and visual performance. Variations in coupling methods, layer materials, and fastening mechanisms enable adaptability for different applications.

19 Claims, 2 Drawing Sheets

DUAL-LAYER ELASTIC BELT WITH ENHANCED DURABILITY AND CUSTOMIZATION

FIELD OF INVENTION

The present invention relates to elastic belts, specifically to belts incorporating a dual-layer construction for improved durability, elasticity, and aesthetic customization. The invention is applicable to fashion, sportswear, and other wearable accessories.

BACKGROUND

Elastic belts have gained significant popularity due to their comfort, adaptability, and versatility in a variety of applications, ranging from casual fashion to specialized uses in sports and outdoor activities. These belts are particularly valued for their ability to conform to different body shapes without compromising functionality or appearance. Traditional elastic belts are often constructed from a single layer of stretchable material, offering basic flexibility and comfort. However, such designs frequently encounter several limitations, particularly in terms of durability, aesthetic customization, and the retention of their original form under prolonged use.

A recurring challenge with single-layer elastic belts lies in the degradation of their structural and visual characteristics over time. When subjected to repeated stretching, the material often loses elasticity, resulting in overstretching and reduced functional lifespan. Additionally, the appearance of these belts tends to deteriorate due to wrinkling, fading, or distortion of any printed or woven designs, which can undermine their aesthetic appeal. This is especially problematic in applications where both style and performance are critical, such as in sportswear or high-end casual accessories.

Attempts to enhance the visual appeal of elastic belts have included integrating printed or woven designs directly onto the elastic material. While these efforts allow for greater customization, they often fail to address the underlying issue of design durability under tension. Designs printed on elastic materials are particularly prone to cracking, fading, or distortion when the material is stretched during use. Furthermore, the lack of additional structural support in single-layer designs can lead to premature wear, limiting the utility and marketability of such products.

In parallel, there has been a growing demand for belts that combine functional flexibility with robust aesthetic qualities, particularly in niche markets such as golfing apparel, where comfort and style are equally prioritized. However, existing solutions in this space, including non-elastic belts or multi-layer constructions with rigid components, often fail to provide the necessary balance between elasticity and design integrity. These products may compromise on either comfort or durability, leaving a gap in the market for a solution that addresses these limitations effectively.

The present invention arises from a recognition of these deficiencies in existing elastic belt designs and the need for an innovative approach that combines the benefits of elasticity, durability, and aesthetic customization. By addressing the drawbacks associated with traditional single-layer constructions and exploring new methods of material integration, the invention seeks to offer a more advanced and versatile solution to meet the evolving demands of consumers in both functional and fashion-forward markets.

It is within this context that the present invention is provided.

SUMMARY

The present invention relates to an elastic belt comprising a dual-layer structure designed to provide durability, elasticity, and aesthetic versatility. The belt includes a first elongate layer formed of elastic material, serving as the foundational base, and a second elongate layer, also made of elastic material, coupled to the first layer. The second layer is secured to the first layer using a coupling mechanism, such as stitching, adhesive, or other fasteners, and is configured to remain attached under tension while allowing elongation of the belt. The belt further incorporates a fastening mechanism at one end for securing it around a user.

This dual-layer construction allows the first layer to provide structural support and primary elasticity while the second layer can be customized with various decorative features. The combination of these layers mitigates overstretching of the decorative layer, ensuring the belt retains its functional and visual integrity during prolonged use. The invention accommodates a range of coupling methods, fastening mechanisms, and material compositions, making it adaptable to various applications.

In some embodiments, the coupling means comprises stitching, which securely attaches the layers and provides even distribution of tensile forces. The stitching may include specific patterns, such as zigzag stitches, to enhance durability.

In further embodiments, the coupling means includes an adhesive layer, offering a smooth and seamless connection between the layers. This approach eliminates the need for visible stitching and may enhance the visual appeal of the belt.

In yet further embodiments, the coupling means is a detachable fastener, such as Velcro, snap fasteners, or magnetic connectors. This allows the second layer to be removed or replaced, enabling customization or repair without replacing the entire belt In some embodiments, the first elongate layer comprises woven elastic webbing, incorporating elastomeric fibers for flexibility and structural support. This configuration provides the base layer with resistance to wear and tear during repeated elongation.

In further embodiments, the second elongate layer comprises a decorative ribbon that incorporates printed, woven, or embroidered patterns. This ribbon may include protective coatings, such as UV-resistant or abrasion-resistant layers, to enhance its durability.

In yet further embodiments, the second elongate layer is coupled to the first elongate layer along the majority of its length, with a terminal portion of the first elongate layer remaining exposed. This configuration reduces bulk at the tail end of the belt, facilitating the addition of reinforced holes for fastening.

In some embodiments, the fastening mechanism is selected from a range of configurations, including prong buckles, slide buckles, magnetic clasps, or friction fasteners. This versatility allows the belt to be adapted for various user preferences and applications.

In further embodiments, the first elongate layer and second elongate layer are each configured to elongate by up to 30% of their original lengths without permanent deformation, ensuring consistent elasticity and long-term durability.

In yet further embodiments, the belt includes a recovery rate of at least 95% following elongation, preventing sagging or loss of tension after repeated use.

In some embodiments, the belt incorporates decorative elements, such as metallic threads, integrated into the second elongate layer to enhance its visual appeal for fashion-focused applications.

In further embodiments, the belt includes leather or synthetic end caps, providing a refined appearance and additional structural reinforcement at the ends of the belt.

In yet further embodiments, the coupling means and fastening mechanism are configured to be detachable, allowing disassembly of the belt for cleaning or replacement of individual components.

In some embodiments, the belt accommodates additional layers between the first and second elongate layers, enabling further customization or functional enhancements.

BRIEF DESCRIPTION OF THE DRAWINGS

Various embodiments of the invention are disclosed in the following detailed description and accompanying drawings.

Figure 1:
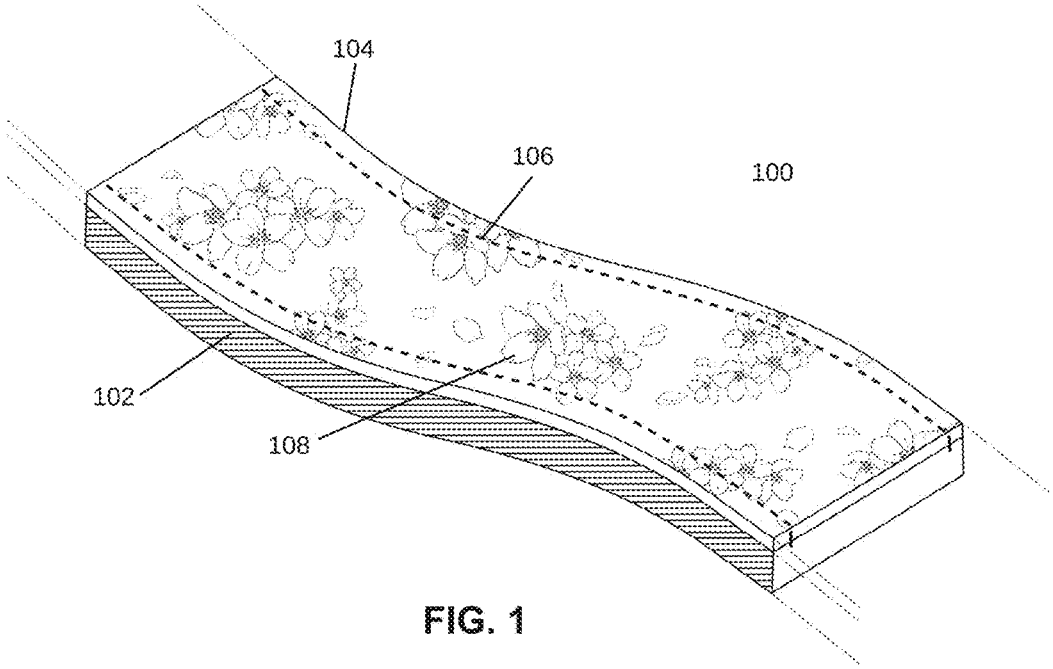
FIG. 1 illustrates an example of a perspective isometric view of a section of the belt in an un-stretched state, showing the first and second elongate layers coupled together.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Definitions

The terminology used herein is for the purpose of describing particular embodiments only and is not intended to be limiting of the invention.

As used herein, the term "and/or" includes any combinations of one or more of the associated listed items.

As used herein, the singular forms "a," "an," and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

When a feature or element is described as being "on" or "directly on" another feature or element, there may or may not be intervening features or elements present. Similarly, when a feature or element is described as being "connected," "attached," or "coupled" to another feature or element, there may or may not be intervening features or elements present. The features and elements described with respect to one embodiment can be applied to other embodiments.

The use of spatial terms, such as "under," "below," "lower," "over," "upper," etc., is used for ease of explanation to describe the relationship between elements when the apparatus is in its proper orientation.

The terms "first," "second," and the like are used to distinguish different elements or features, but these elements or features should not be limited by these terms. A first element or feature described can be referred to as a second element or feature and vice versa without departing from the teachings of the present disclosure.

The term "elastic material" refers to any material capable of elongation under tension and returning to its original shape upon release of the tension. This includes, but is not limited to, woven or non-woven fabrics incorporating elastomeric fibers such as spandex, latex, rubber, or combinations thereof. In one example implementation, the elastic material may be a woven webbing comprising 70% polyester for durability and 30% spandex for flexibility, providing a balance of elasticity and strength.

The term "elongate layer" refers to a substantially linear or belt-like structure that extends along a longitudinal axis. This includes layers of varying widths, thicknesses, and material compositions, provided they exhibit elongation and recovery properties. In one example implementation, an elongate layer may have a width of 25-40 mm, a thickness of 1.5-2 mm, and be formed from woven elastic webbing for structural support.

The term "coupling means" refers to any mechanism or method for securing the second elongate layer to the first elongate layer to maintain their positional relationship during elongation. This includes, but is not limited to, stitching, adhesive bonding, hook-and-loop fasteners, snap fasteners, or magnetic coupling. In one example implementation, the coupling means may include a zigzag stitching pattern using high-tensile nylon thread to ensure durability under repeated tension.

The term "fastening mechanism" refers to any structure or component that allows the belt to be releasably secured around a user. This includes, but is not limited to, prong buckles, slide buckles, magnetic clasps, or friction fasteners. In one example implementation, the fastening mechanism may be a prong buckle attached to one end of the belt and configured to engage reinforced holes along the length of the first elongate layer.

The term "protective coating" refers to any surface treatment or application intended to improve the durability or appearance of the elastic materials. This includes coatings that are UV-resistant, abrasion-resistant, or moisture-resistant. In one example implementation, the protective coating may be a polyurethane layer applied to the second elongate layer to prevent fading or cracking of printed designs.

The term "recovery rate" refers to the percentage of an elongate layer's original length that is regained after being subjected to tensile stress. A high recovery rate indicates minimal permanent deformation. In one example implementation, an elongate layer composed of a spandex-polyester blend may achieve a recovery rate of at least 95%, ensuring longevity under repeated use.

The term "decorative ribbon" refers to any elongate layer designed for aesthetic purposes, incorporating visual enhancements such as patterns, textures, or embellishments. This includes woven, printed, or embroidered designs. In one example implementation, the decorative ribbon may include jacquard-woven patterns with metallic threads to create a visually appealing finish while maintaining flexibility.

DESCRIPTION OF DRAWINGS

The present invention relates to an elastic belt featuring a dual-layer construction, specifically designed to address the shortcomings of conventional elastic and non-elastic belts. By combining a first elongate layer formed of elastic webbing with a second elongate layer formed of an elastic decorative ribbon, the invention achieves a balance of durability, elasticity, and aesthetic customization that is not readily achieved in the prior art. This dual-layer structure ensures that both the functional and visual characteristics of the belt are preserved under repeated use and stretching.

Traditional elastic belts, which are typically composed of a single layer of stretchable material, are prone to overstretching, deformation, and premature wear. Furthermore, printed or woven designs on these belts often crack, fade, or distort when subjected to tension, limiting their utility in applications requiring both functionality and visual appeal. Non-elastic belts, while offering better design retention, lack the flexibility and comfort necessary for many users. The present invention overcomes these limitations through a layered approach, where the first elongate layer provides structural support and manages tensile stress, while the second elongate layer offers an elastic surface for customization with designs or patterns that are resistant to distortion.

The coupling of the two layers ensures that the elongation of the second, thinner ribbon layer is constrained by the first, thicker base layer. This feature minimizes overstretching of the decorative layer, preserving its visual integrity over time. Additionally, the invention incorporates a coupling means, such as stitching or adhesive bonding, that provides a durable connection between the layers while allowing for flexibility. This arrangement not only enhances the durability of the belt but also facilitates design versatility by enabling a variety of decorative treatments on the upper layer.

The invention also addresses the functional limitations of existing belts through its adaptability to different fastening mechanisms and configurations. The belt is designed to accommodate prong buckles, slide buckles, or other closure types, with reinforced sections to prevent damage during repeated fastening and unfastening. Furthermore, the dual-layer construction allows for selective application of the upper decorative layer, enabling the belt to be tailored for specific styles or use cases, such as in casual wear, sportswear, or premium fashion.

In FIG. 1, a perspective isometric view of a section of the belt 100 in an un-stretched state is depicted. The belt 100 includes a first elongate layer 102, which forms the base layer, and a second elongate layer 104, which serves as the decorative ribbon layer. The first elongate layer 102 is visibly thicker than the second elongate layer 104, providing structural support to the belt 100. The two layers are coupled together along their overlapping surfaces using stitching 106, which runs longitudinally along both sides of the belt 100. The second elongate layer 104 features a decorative pattern 108 visible along its top surface. While the figure shows the coupling achieved by stitching 106, other coupling means such as adhesive bonding or hook-and-loop fasteners may be used in alternative embodiments. The materials of the first elongate layer 102 may include woven elastic webbing with a blend of polyester and spandex, while the second elongate layer 104 may be made of an elastic material customized with printed or woven patterns.

Figure 2:
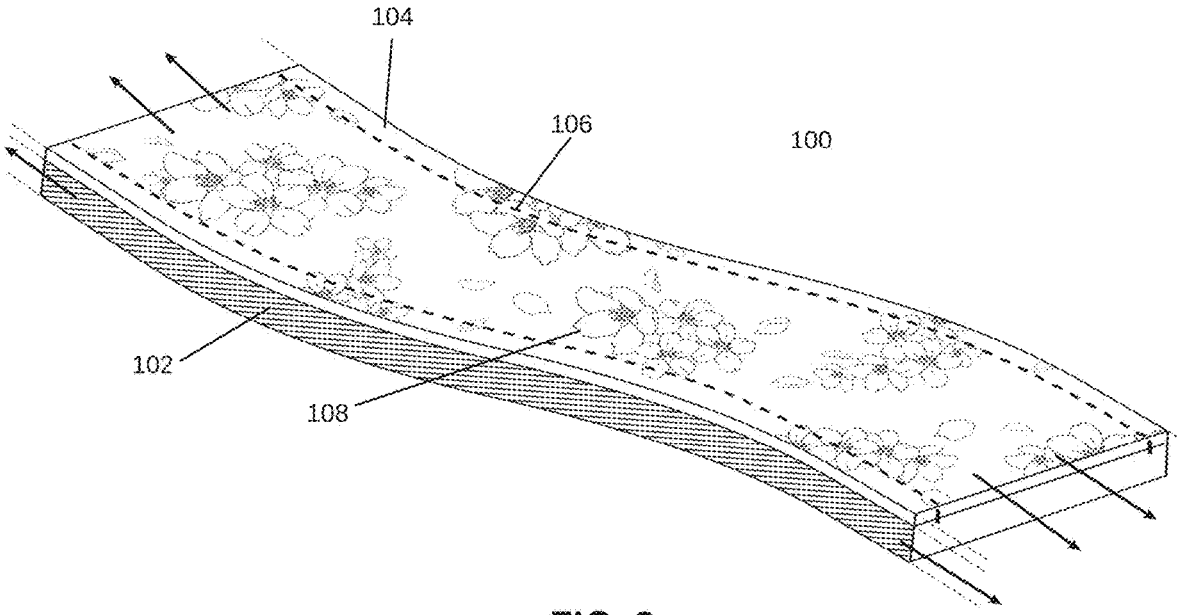
FIG. 2 illustrates an example of a perspective isometric view of a section of the belt in a stretched state, showing the elongation of the first and second elongate layers.

In FIG. 2, the belt 100 is shown in a stretched state, illustrating the elongation of both the first elongate layer 102 and the second elongate layer 104. The decorative pattern 108 on the second elongate layer 104 stretches proportionally with the first elongate layer 102 but remains intact and undistorted due to the coupling provided by stitching 106. The stitching 106 ensures that the second elongate layer 104 is prevented from overstretching beyond its elastic limit, maintaining the integrity of the decorative pattern 108. The materials of the first elongate layer 102 are designed to distribute tensile forces evenly across the belt, while the second elongate layer 104 remains constrained within the elastic capacity of the base layer.

Figure 3:
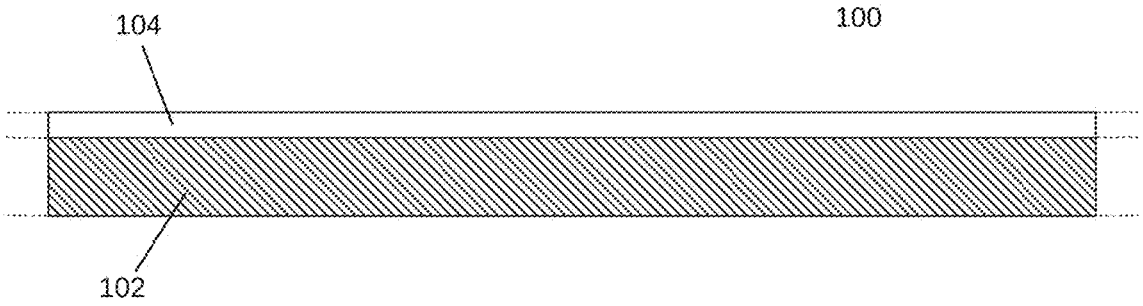
FIG. 3 illustrates an example of a side view of the belt in an un-stretched state, showing the relative thickness of the first and second elongate layers and their coupling.

In FIG. 3, a side view of the belt 100 is shown, illustrating the relative thickness of the first elongate layer 102 and the second elongate layer 104.

Figure 4:
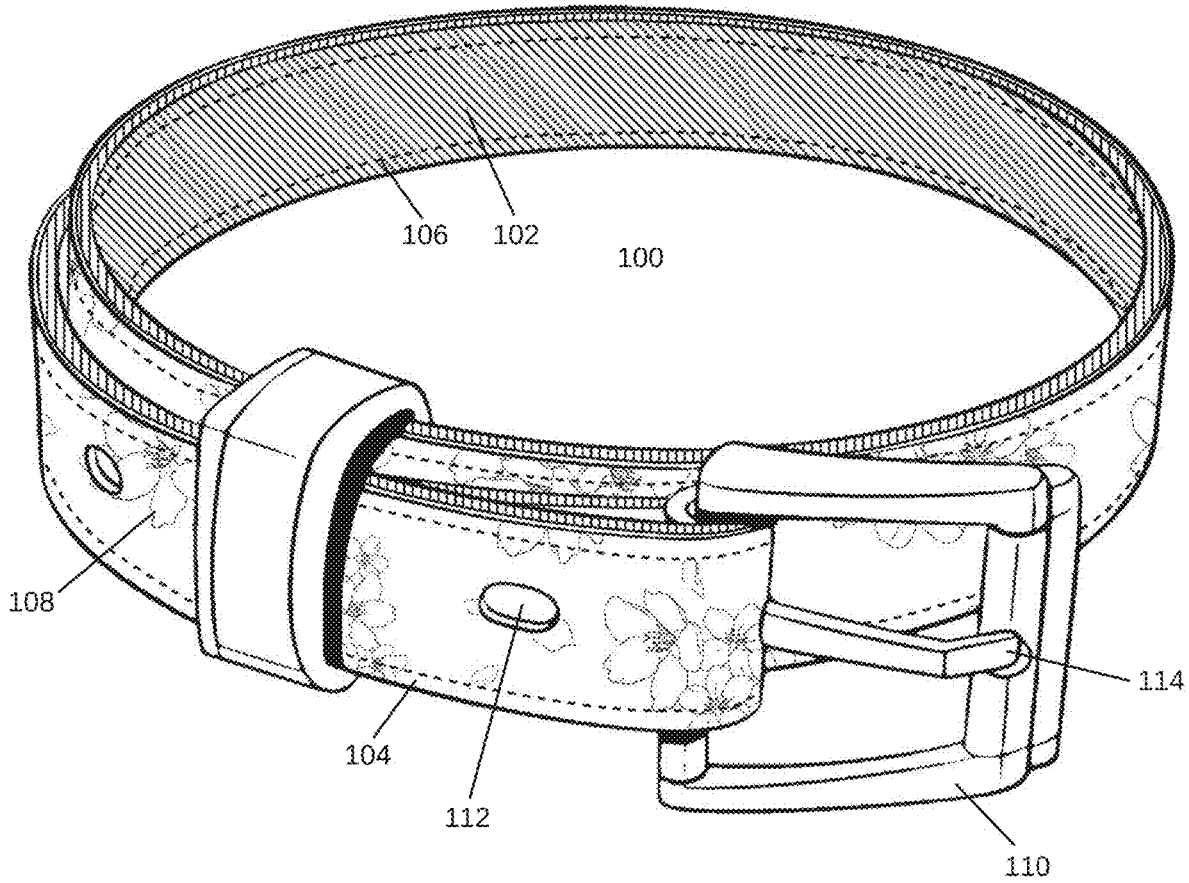
FIG. 4 illustrates an example of a perspective view of the entire belt, showing the buckle, belt holes, and decorative pattern.

In FIG. 4, a perspective view of the entire belt 100 is depicted. The belt includes a buckle 110 located at one end of the first elongate layer 102. The belt holes 112 are evenly spaced along the terminal portion of the first elongate layer 102, allowing for adjustable fastening using the prong 114 of the buckle 110. The decorative pattern 108 on the second elongate layer 104 runs along its visible surface for most of the belt's length.

In alternative embodiments, the decorative pattern 108 may include woven metallic threads or custom embroidery, and the buckle 110 may be a slide buckle or magnetic clasp instead of the prong buckle shown.

Although not shown in the figures, the belt can also be configured to include alternative coupling means for attaching the second elongate layer to the first elongate layer. For example, in some embodiments, the coupling means may be an adhesive layer applied between the two elongate layers. The adhesive may be a pressure-sensitive or heat-activated type, providing a seamless bond that eliminates the need for stitching. In other embodiments, detachable coupling mechanisms, such as hook-and-loop fasteners or snap fasteners, may be used, allowing for the removal and replacement of the second elongate layer to customize the belt's appearance.

In some configurations, the belt may incorporate a second elongate layer made from materials with metallic threads, embroidered designs, or jacquard weaves to enhance the aesthetic options. These decorative materials may also include protective coatings, such as UV-resistant, abrasion-resistant, or moisture-resistant treatments, to ensure longevity and preserve the decorative elements under various environmental conditions.

The fastening mechanism, while depicted as a prong buckle in FIG. 4, may also take alternative forms. For instance, the belt can be configured with a slide buckle or a magnetic clasp, each providing a different method of adjustable and secure fastening. The buckle may further include decorative elements or logos to match the overall design theme of the belt.

In yet further embodiments, the belt may include additional features at its ends. For example, a leather or faux leather cap may be attached to one or both ends of the belt to enhance durability and provide a premium aesthetic. Alternatively, the ends of the belt may be heat-sealed to prevent fraying, especially in configurations where the second elongate layer extends to the terminal portion of the belt.

The belt can also be configured with variable layer proportions. For example, the width of the second elongate layer may be slightly narrower than the first elongate layer, allowing the edges of the first elongate layer to remain visible. This configuration provides a subtle design contrast and reduces the likelihood of wear along the edges of the second elongate layer.

Additionally, the belt may be designed to incorporate modular components. For instance, the second elongate layer could be attached in sections rather than as a single continuous ribbon, allowing for multiple patterns or materials to be combined along the length of the belt. In this configuration, each section could be individually replaced or customized without affecting the overall structure of the belt.

In other configurations, the belt may accommodate additional layers inserted between the first and second elongate layers. These intermediate layers could include functional elements, such as padding for added comfort, or decorative layers that contribute to the overall design. The coupling means would be adapted to secure all layers together effectively while maintaining the flexibility and elasticity of the belt.

Although the decorative ribbon shown in the figures features patterns visible along its top surface, it may also include hidden functional elements, such as reflective strips or integrated electronic components for smart belt applications. In such embodiments, the second elongate layer could serve a dual purpose, providing both aesthetic and functional capabilities.

CONCLUSION

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the belt structure of the invention have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An elastic belt comprising:

a first elongate layer formed of an elastic material and having a first width, a first thickness, an upper surface, and a lower surface;

a second elongate layer formed of an elastic material and having a second width, a second thickness, an upper surface, and a lower surface, wherein the second width is substantially equal to or less than the first width and the second thickness is less than the first thickness;

a coupling means securing the lower surface of the second elongate layer to the upper surface of the first elongate layer along at least a portion of their respective lengths, the coupling means configured to maintain the positional relationship between the first elongate layer and the second elongate layer during elongation;

a fastening mechanism disposed at a first end of the first elongate layer, the fastening mechanism configured to releasably secure the belt around a user; and wherein the second elongate layer is coupled to the first elongate layer along a majority of the length of the second elongate layer, and at least one terminal portion of the first elongate layer is exposed and lacks the second elongate layer.

2. The elastic belt of claim 1, wherein the coupling means comprises stitching extending longitudinally along at least a portion of the overlap between the first elongate layer and the second elongate layer.

3. The elastic belt of claim 2, wherein the stitching comprises a zigzag stitch pattern configured to distribute tensile forces evenly across the layers.

4. The elastic belt of claim 1, wherein the coupling means comprises an adhesive layer disposed between the first elongate layer and the second elongate layer.

5. The elastic belt of claim 1, wherein the coupling means comprises a detachable fastener selected from the group consisting of Velcro, snap fasteners, magnetic fasteners, and hook-and-loop connectors.

6. The elastic belt of claim 1, wherein the first elongate layer is a woven elastic webbing comprising elastomeric fibers integrated into a textile matrix.

7. The elastic belt of claim 1, wherein the second elongate layer comprises a decorative ribbon incorporating printed, woven, or embroidered patterns.

8. The elastic belt of claim 7, wherein the second elongate layer includes a protective coating selected from the group consisting of UV-resistant coatings, abrasion-resistant coatings, and moisture-resistant coatings.

9. The elastic belt of claim 1, wherein the exposed terminal portion of the first elongate layer includes a plurality of reinforced holes configured to receive a prong of the fastening mechanism.

10. The elastic belt of claim 1, wherein the fastening mechanism is selected from the group consisting of a prong buckle, a slide buckle, a magnetic clasp, and a friction fastener.

11. The elastic belt of claim 1, wherein the first elongate layer has a thickness of 1.5 mm to 2 mm and the second elongate layer has a thickness of 0.5 mm to 1 mm.

12. The elastic belt of claim 1, wherein the first elongate layer and the second elongate layer are each configured to elongate by up to 30% of their original lengths without permanent deformation.

13. The elastic belt of claim 1, wherein the first elongate layer has a recovery rate of at least 95% following elongation.

14. The elastic belt of claim 1, further comprising a cap element attached to at least one end of the belt, the cap element being formed of leather or a synthetic equivalent.

15. The elastic belt of claim 1, wherein the second elongate layer includes metallic threads or decorative elements integrated into its structure.

16. The elastic belt of claim 1, wherein the first elongate layer includes a color distinct from the second elongate layer.

17. The elastic belt of claim 1, wherein the first elongate layer and the second elongate layer are manufactured from materials with differing levels of elasticity.

18. The elastic belt of claim 1, wherein the coupling means and fastening mechanism are configured to be detachable to allow disassembly of the belt for cleaning or replacement of the layers.

19. The elastic belt of claim 1, wherein the belt is configured to accommodate additional layers between the first elongate layer and the second elongate layer.

* * * * *